US007278355B2

(12) United States Patent
Yu

(10) Patent No.: US 7,278,355 B2
(45) Date of Patent: Oct. 9, 2007

(54) ENHANCED EFFICIENCY PYROTECHNIC SHELL

(75) Inventor: Peter Yu, Florence, AL (US)

(73) Assignee: American Promotional Events, Inc., Florence, AL (US)

( * ) Notice: Subject to any disclaimer, the term of this patent is extended or adjusted under 35 U.S.C. 154(b) by 489 days.

(21) Appl. No.: 10/887,262

(22) Filed: Jul. 8, 2004

(65) Prior Publication Data

US 2005/0109232 A1 May 26, 2005

Related U.S. Application Data

(60) Provisional application No. 60/485,914, filed on Jul. 10, 2003.

(51) Int. Cl.
*F42B 4/14* (2006.01)

(52) U.S. Cl. ..... 102/352; 102/357; 102/361

(58) Field of Classification Search ..... 102/352, 102/357, 361
See application file for complete search history.

(56) References Cited

U.S. PATENT DOCUMENTS 1,922,156 A * 8/1933 Fabrizio ..... 102/357
1,972,478 A * 9/1934 Fabrizio ..... 102/361
2,103,936 A * 12/1937 Decker ..... 102/357
3,227,084 A * 1/1966 Stokes et al. ..... 102/361
6,283,033 B1 9/2001 Wu et al.

FOREIGN PATENT DOCUMENTS

JP 10274500 A * 10/1998

* cited by examiner

*Primary Examiner*—Michelle Clement
(74) *Attorney, Agent, or Firm*—Paul M. Denk

(57) ABSTRACT

A multiple stage pyrotechnic shell apparatus is disclosed. The invention has enhanced efficiency to increase lift and reduce the risk of one or more of the charges from exploding near the ground. The enhanced efficiency is obtained through the novel use of shaped breaks that conform to the shape of the inner surface of the shell's launch tube, and in particular through the use of cylindrically shaped breaks in round launch tubes. In addition, the present invention further enhances efficiency by configuring the breaks such that all the breaks weigh the same or the upper breaks weigh more than the lower breaks in the launch tube.

10 Claims, 2 Drawing Sheets

ENHANCED EFFICIENCY PYROTECHNIC SHELL

CROSS REFERENCE TO RELATED APPLICATIONS

This nonprovisional patent application claims priority to the provisional patent application having Ser. No. 60/485,914, which was filed on Jul. 10, 2003.

BACKGROUND OF THE INVENTION

The invention relates to a new pyrotechnic shell apparatus, and more particularly to a multiple stage pyrotechnic shell apparatus having enhanced efficiency to increase lift and reduce the risk of one or more of the charges from exploding near the ground.

Multiple stage pyrotechnic shells typically comprise two or more pyrotechnic modules, known as "breaks" that are housed within a single launch tube. A launch charge is located in the tube below the breaks. The breaks are linked to one another and intended to sequentially discharge and produce a pyrotechnic effect once the breaks are launched a safe distance into the sky by the launch charge. Typically each of the breaks is configured in a spherical shape.

Unfortunately, the spherical shape of the breaks in a conventional multiple stage pyrotechnic shell allows the expanding gases from the launch charge to escape between the breaks and the inner surface of the launch tube, resulting in substantial loss of pressure during launch. This limits the launch height of a conventional multiple stage pyrotechnic shell. The limited launch height of a conventional multiple stage pyrotechnic shell therefore presents a greater risk of unacceptable and dangerous low-level discharge of the individual breaks.

In addition, in a conventional multiple stage pyrotechnic shell, the powder weight varies between the breaks in the shell. In particular, traditionally, the break nearest the bottom of the shell has the most powder weight, with each successive break above the bottom break having a successively lower powder weight. This causes the grouping of breaks to tumble during flight and the resultant inefficiency further hinders the ability of the breaks to attain maximum height, and also adds to the risk of unacceptable and dangerous low-level discharge of the individual breaks.

U.S. Pat. No. 6,383,033, for example, discloses a multiple stage pyrotechnic shell apparatus having three breaks. In order to minimize the potential for tumbling, the '033 Patent discloses that the breaks are all uniaxial and the weights of the three breaks are distributed along the central axis such that the center of gravity of the shell is below the vertical midpoint. The shell apparatus of the '033 Patent is further restricted to having a total break weight of less than 40 grams.

BRIEF SUMMARY OF THE INVENTION

The present invention comprises a fireworks shell that includes two or more breaks, where each said break is coupled to at least one other break. The breaks each contain a break charge and a break effect, and each break has a specific outer perimeter. Preferably, the breaks are attached to one another in a sequential fashion so as to form a single linear grouping. Fuses are located between the individual breaks, linking the break charges of adjacent breaks.

A launch tube, having a specific interior cross-section, houses at least one of, and preferably all of, the individual breaks. The shape of the interior cross-section of the tube and the outer perimeter of at least one of the breaks contained in the tube are configured such that the perimeter of the break is elongated and has a cross-section essentially equivalent in shape to the interior cross-section of said tube.

In the preferred embodiment, the interior surface of the tube is cylindrical and the shape of the break at the bottom of the tube is likewise cylindrical, but of a slightly smaller diameter, such that upon ignition of the launch charge located below the bottom break, a greater amount of the expanding gases will more efficiently propel the breaks into the air above the shell than in a conventional shell having round breaks.

BRIEF DESCRIPTION OF THE DRAWINGS

The objects of the invention are achieved as set forth in the illustrative embodiments shown in the drawings that form a part of the specification.

DESCRIPTION OF THE PREFERRED EMBODIMENT

Figure 1:
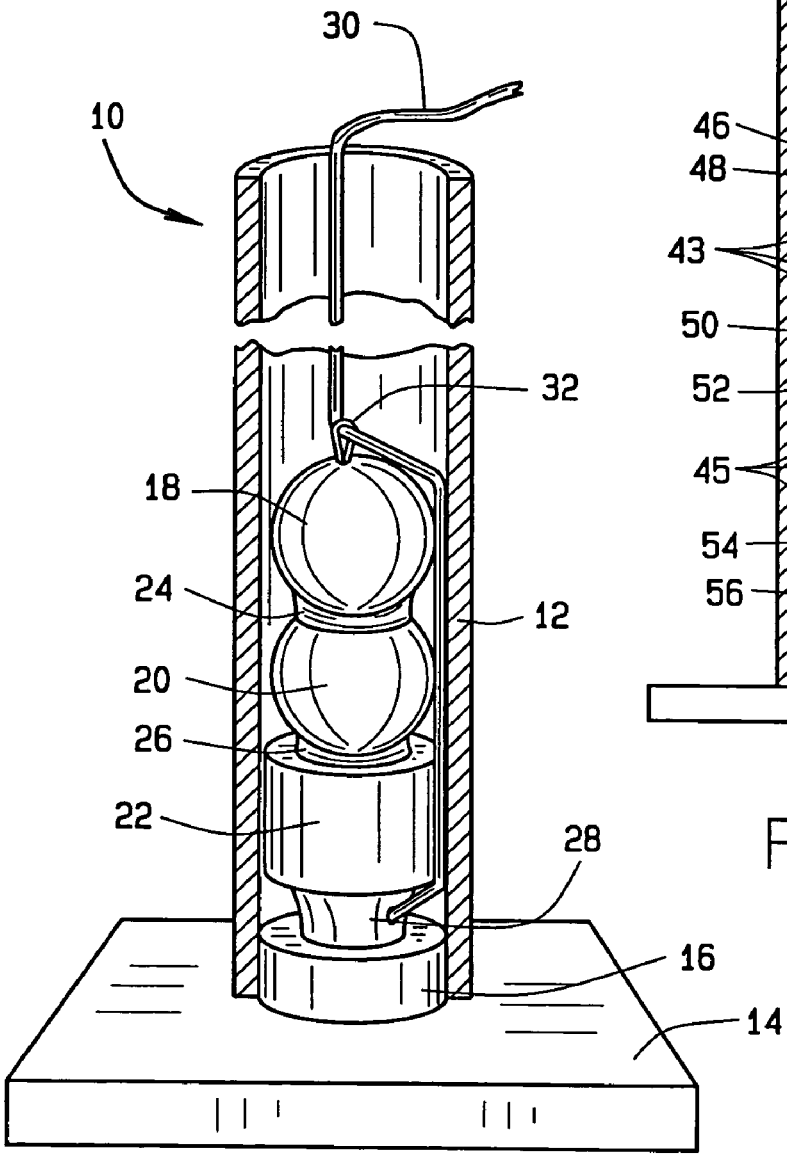
FIG. 1 is a partial cut-away perspective view of the preferred embodiment of the present invention having three coaxial breaks with the first break being cylindrical in shape.

The multiple stage pyrotechnic shell apparatus of the preferred embodiment is indicated generally at 10 (FIG. 1). The shell 10 includes a tube 12, a generally flat base 14 positioned below the tube 12 and joined with the bottom of the tube 12, and a base plug 16 that is integral with and extending from the base 14, the plug 16 configured to fit snugly within and being secured to the inner surface of the bottom of the tube 12.

Three pyrotechnic breaks 18, 20, 22 are positioned sequentially within the tube 12, the cylindrical break 22 being positioned at the bottom of the tube 12 and the round breaks 18, 20 positioned above the break 22. The breaks 18, 20 are joined together with a paper connect 24 and the breaks 20, 22 are joined together with a paper connect 26. A lift charge compartment 28 is attached to the bottom of the cylindrical break 22 and rests against the top of the plug 16 within the tube 12.

A fuse 30 extends from the interior of the lift charge 28, to the inner surface of the tube 12, then extends upward through the tube 12 between the breaks 18, 20, 22 and the inner surface of the tube 12. At the top of the break 18, the fuse 30 extends from the inner surface of the tube 12 through a fuse holder loop 32 attached to the top of the break 18. The fuse holder loop 32 is constructed of string. From the fuse holder loop 32, the fuse 30 extends up and out of the top of the tube 12.

Figure 2:
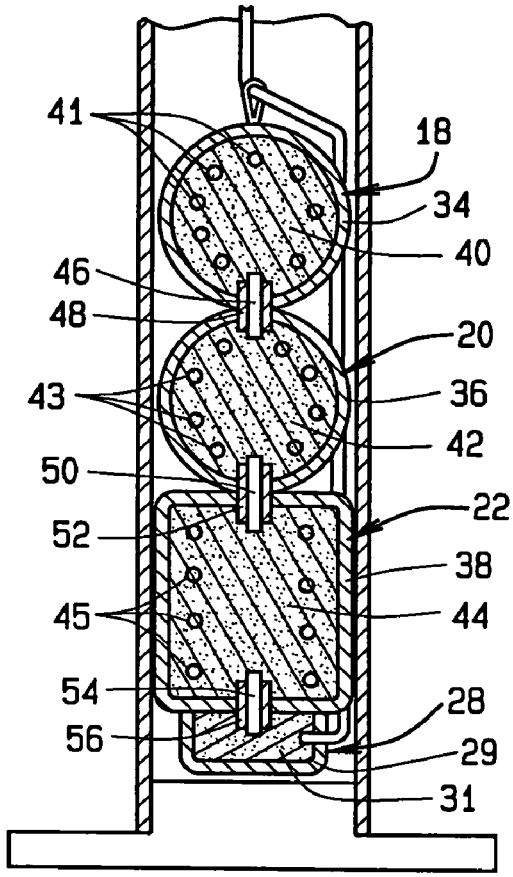
FIG. 2 is a cross-sectional view of the preferred embodiment of the present invention having three coaxial breaks with the first break being cylindrical in shape.

Referring to FIG. 2, it can be seen that each of the breaks 18, 20, 22 includes a housing 34, 36, 38, respectively, such that each housing 34, 36, 38 contains a break charge 40, 42, 44, respectively. The break charges 40, 42, 44 may be comprised of a number of combustible materials, including for example, a mixture of 70% Potassium Nitrate (KNO3), 5% Surfer (S) and 25% Carbon (C). (See Chart 5 of Appendix A; Appendix A being attached hereto and incorporated by reference herein). Similarly, the lift charge compartment 28 includes a housing 29 that contains a lift charge 31. The lift charge 31 contained within the lift charge compartment 28 may also be comprised of a number of combustible materials, including for example, a mixture of 70% Potassium Nitrate (KNO3), 5% Surfer (S) and 25% Carbon (C). (See Chart 5 of Appendix A).

Each of the breaks 18, 20, 22 also includes one or more effects 41, 43, 45 contained within the housing 34, 35, 38 respectively. Effects are pyrotechnic compositions that burst into various colors and configurations upon combustion. For example, in addition to being one or more of numerous colors, the effect may be glittering, spinning, exploding, etc. As would be readily understood by one of ordinary skill in the art, the effects 41, 43, 45 may be comprised of a number of combustible materials. For example, a mixture of 43% Potassium Perchlorate (KclO4), 20% Sodium Oxalate (Na2C2O4), 10% Strontium Nitrate (Sr(NO3)2), 20% Al-Mg Alloy (Magnalium) and 7% Penolic Resin (Resinox) will produce a golden effect. (See Chart 5 of Appendix A).

As the charts contained in Appendix A reveal, the combined weight of the pyrotechnic composition for a single shell of the preferred embodiment, including break charges and effects, totals between 52.2 and 56.2 grams, depending on the specific combination of charges and effects in the shell. Because the lift charges will range between 6 to 10 grams, the total weight of a shell, including the lift charge weight, can exceed 60 grams, if authorized by regulations.

A paper fuse 46 extends from the lower portion of the break charge 40 in the break 18 to the upper portion of the break charge 42 in the break 20. The fuse 46 is surrounded about its midsection by a primer 48. A second paper fuse 50 extends from the lower portion of the break charge 42 in the break 20 to the upper portion of the break charge 44 in the break 22. The fuse 50 is surrounded about its midsection by a primer 52. A third paper fuse 54 extends from the lower portion of the break charge 44 to the upper portion of the lift charge 31 in the lift charge compartment 28. The fuse 54 is surrounded about its midsection by a primer 56.

As can be readily seen and understood, prior to operation, a user will place the shell apparatus 10 on a generally flat surface outdoors, positioned with the base 14 set flat against the ground surface and the open end of the tube 12 facing upward. When the user applies an ignition source to the fuse 30 atop the tube 12, the fuse 30 will burn down into the tube 12, through the fuse holder loop 32, down the inner side of the tube 12 along the breaks 18, 20, 22, and into the lift charge housing 29, where the fuse 30 ignites the lift charge 31.

The combustion of the lift charge 31 causes an explosion below the break 22 that generates high pressure from the gases expelled during the explosion. As can be appreciated, owing to the cylindrical shape of the break 22, the housing 38 of the break 22 is in close proximity to the inner sidewall of the tube 12 for a substantially greater length than in conventional pyrotechnic shells having only round breaks. The break 22 therefore allows very little of the expanding gases escape between the break 22 and the inner surface of the tube 12. In contrast, conventional pyrotechnic shells incorporate round breaks that allow a much greater volume of expanding gases to escape because the length of the gap between the round break and the inside of the tube is so short. Hence, the novel design of the present invention dramatically increases the efficiency of the pyrotechnic shell 10 over conventional shells that exclusively utilize round breaks.

The novel design of the present invention also enables the total weight of the breaks in a single shell to exceed the present weight limit of 40 grams in conventional multiple stage pyrotechnic shells.

In addition, the upper breaks in a conventional multiple stage pyrotechnic shell would weigh less than the lower breaks. In certain embodiments of the present invention, however, the upper breaks may weigh the same, or even more, than the bottom break 22. This creates more stability among the breaks during flight, thereby reducing the inefficiencies of drag caused by tumbling, as occurs in conventional shells.

Figure 3:
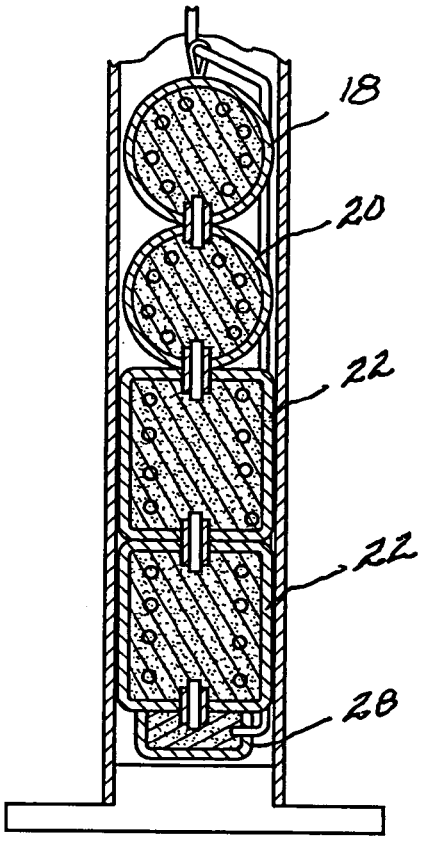
FIG. 3 is a cross-sectional view of another embodiment of the present invention having four coaxial breaks with the first two breaks being cylindrical in shape.
Figure 4:
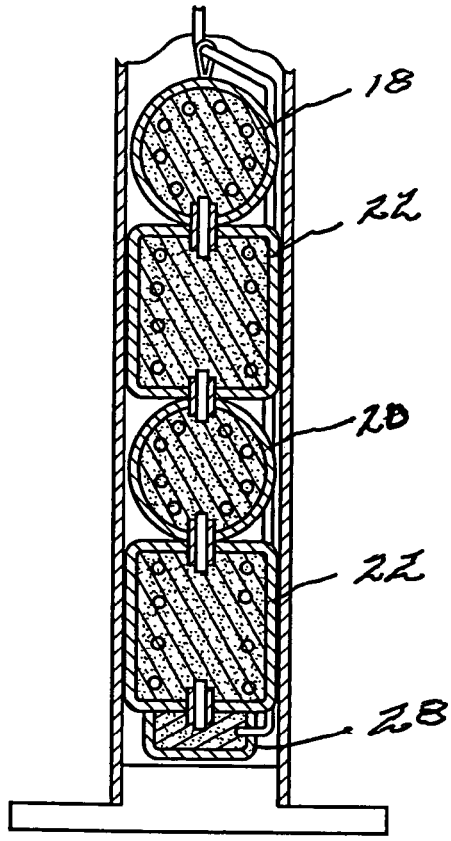
FIG. 4 is a cross-sectional view of yet another embodiment of the present invention having four coaxial breaks with the first and third breaks being cylindrical in shape.
Figure 5:
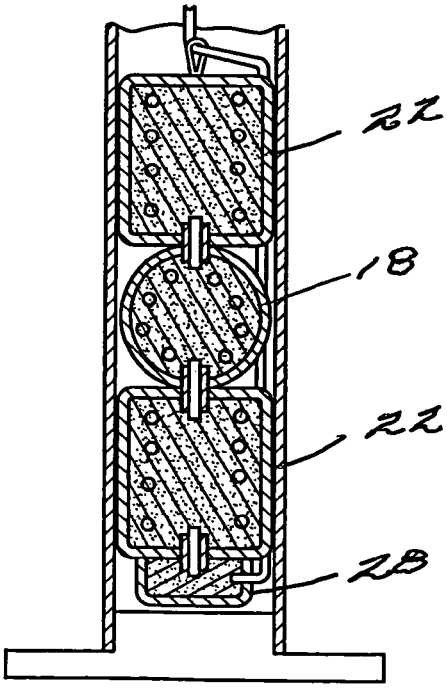
FIG. 5 is a cross-sectional view of yet another embodiment of the present invention having three coaxial breaks with the first and third breaks being cylindrical in shape.
Figure 6:
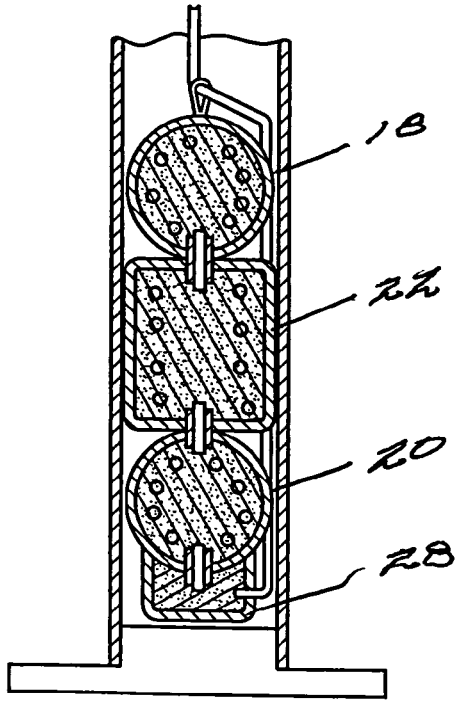
FIG. 6 is a cross-sectional view of yet another embodiment of the present invention having three coaxial breaks with the second break being cylindrical in shape.

As can be seen from FIGS. 3-6, the application of the novel use of cylindrical breaks in a multiple stage pyrotechnic shell is not limited to either the use of only one cylindrical break, or restricting the location of the cylindrical shell to the bottom of the tube. Rather, other embodiments of the present invention are considered. For example, there may be more than one such cylindrical break in a single pyrotechnic shell. (FIGS. 3-5). There may be more than three breaks in a single shell; e.g. four breaks in each shell. (FIGS. 3-4). A cylindrical break may be placed in positions other than at the bottom of the tube. (FIGS. 3-6). Further, all of the breaks may be cylindrical.

In addition, the diameter of the tube and the breaks may vary so long as the outer diameter of at least one of the cylindrical breaks is slightly less than the inner diameter of the tube. Of course, there may be more than four breaks in each tube. One or more of the breaks may be placed in the tube without being rigidly attached to other breaks. The breaks may be of different shapes so long as at least one of the breaks is shaped to have an extended portion of its outer surface the same shape as, but slightly smaller than, the inner shape of the tube. For example, cross-section of the tube may be square, oval, or some other shape. If the cross-section of the tube is square, at least one of the breaks would need to likewise be essentially square, but with a perimeter slightly smaller than the perimeter of the inner surface of the tube.

No base is required if the tube is configured to be closed at the bottom end. Of course, the base itself may be of any number of configurations including, but not limited to, the following:

a. a simple plug at the base of the tube;
b. a flat plate with a circular groove cut in the top surface, where the groove receives the tube;
c. a simple flat plate to which the tube is attached with glue, some other adhesive, of with some other attachment means such as brackets or clips;
d. the bottom of the base may be irregular, for use on uneven surfaces;
e. a cavity may be formed in the base to house the lift charge;

The tube 12, the break housings 34, 36, 38, and the lift charge housing 29, may all be comprised of a variety of materials, such as paper, plastic, metals, wood, or other material, so long as the material facilitates the proper operation of the pyrotechnic apparatus. The fuse 30 may exit the shell at locations other than through the top of the tube

12. For example, the fuse 30 may exit the shell at any position along the side of the tube 12, or through the base 14.

Other configurations incorporating the novel use of one or more cylindrical breaks in a multiple stage pyrotechnic shell may be readily discerned by one of ordinary skill in the art.

I claim:

1. A fireworks shell comprising:

a. a plurality of breaks, each said break being coupled to at least one other break, each said break containing a break charge; and b. a cylindrical launch tube containing said breaks; wherein one of said breaks contained in said tube is cylindrical and the total weight of all of the breaks is equal to or greater than 40 grams.

2. The fireworks shell of claim 1 wherein the all of the breaks have a circular cross-section of equal diameter.

3. The fireworks shell of claim 1 wherein each of said breaks has a weight and all of said break weights are essentially equal.

4. The fireworks shell of claim 1 wherein each of said breaks has a weight, said breaks being vertically stacked within the fireworks shell extending from a lower break to an upper break, and wherein the break weight of the upper break exceeds the break weight of the lower break within the launch tube.

5. The fireworks shell of claim 1 wherein the breaks are positioned one atop another.

6. The fireworks shell of claim 1 wherein an elongated break is provided within the launch tube and positioned below all of said other breaks.

7. The fireworks shell of claim 1 comprising three breaks.

8. The fireworks shell of claim 1 comprising four breaks.

9. The fireworks shell of claim 1 wherein each of the breaks is essentially equal in weight.

10. The fireworks shell of claim 1 wherein the total weight of all the breaks is in excess of 40 grams.

* * * * *